US005884747A

United States Patent [19]

Sandstedt et al.

[11] Patent Number: 5,884,747

[45] Date of Patent: Mar. 23, 1999

[54] METHOD AND AN ARRANGEMENT FOR IDENTIFYING AND FINDING A GRIPPER IN A GRIPPING CONVEYOR FOR PRINTED PRODUCTS

[75] Inventors: Håkan Sandstedt, Eksjö; Jan Olof Bergsten, Aneby; Lars Schön, Bodafors, all of Sweden

[73] Assignee: IDAB Wamac AB, Eksjö, Sweden

[21] Appl. No.: 875,993

[22] PCT Filed: Feb. 16, 1996

[86] PCT No.: PCT/SE96/00211

§ 371 Date: Oct. 10, 1997

§ 102(e) Date: Oct. 10, 1997

[87] PCT Pub. No.: WO96/26143

PCT Pub. Date: Aug. 29, 1996

[30] Foreign Application Priority Data

Feb. 24, 1995 [SE] Sweden ..... 9500691

[51] Int. Cl.[6] ..... B65G 43/00

[52] U.S. Cl. ..... 198/349.95; 198/502.3; 198/470.1; 198/349.5

[58] Field of Search ..... 198/502.3, 470.1, 198/349.5, 349.95

[56] References Cited

U.S. PATENT DOCUMENTS 3,373,623 3/1968 Gutting ..... 198/502.3

3,696,946 10/1972 Hunter et al. .

4,274,783 6/1981 Eineichner et al. ..... 198/349.95

FOREIGN PATENT DOCUMENTS

0561308A1 9/1993 European Pat. Off. .

*Primary Examiner*—William E. Terrell
*Assistant Examiner*—Mark Deuble
*Attorney, Agent, or Firm*—Evenson, McKeown, Edwards & Lenahan, PLLC

[57] ABSTRACT

A method and arrangement for identifying and finding the grippers of a gripping conveyor used to transport printed products. The gripping conveyor is divided into a number of sections wherein the length of each section is sufficiently short to enable length variations of the section to be avoided in operation. A group of grippers at the end of each section form an identification code for the following section. The code may be compiled by virtue of each gripper in the group either carrying or not carrying a marker, such that the grippers will form a binary code. The gripper located before the code may carry a marker which indicates the beginning of the code and the beginning of the following section. A sensor senses the code and thereby finds the section of interest. A given gripper within the section can then be found by its position in the section. A gripper counter which senses the serial number of the gripper in the section may also be used.

10 Claims, 2 Drawing Sheets

METHOD AND AN ARRANGEMENT FOR IDENTIFYING AND FINDING A GRIPPER IN A GRIPPING CONVEYOR FOR PRINTED PRODUCTS

The present invention relates to a method and to an arrangement of the kind defined in the preamble of the following independent method Claim and independent apparatus Claim.

The invention thus relates to a method and to an arrangement for identifying and finding the grippers in a gripping conveyor in the transportation of printed products. The method and arrangement enable a check to be kept on a particular product in any of the grippers and to enable actuation of the product as it is conveyed by the conveyor.

Gripping conveyors provide a convenient possibility of keeping an account of a product, such as a newspaper or like product, during its transportation, for instance as it is conveyed from the station in which the newspaper is gripped by a gripper on the conveyor, through a first treatment station and to a second treatment station which may be a laying-off station in which a newspaper bundle is formed. In this regard it is possible to measure the conveyor distance from the point at which the product was gripped to the point at which the gripper shall be opened at the laying-off station. This distance can be measured as a multiple of the gripper spacing on the conveyor chain. Thus, after the moment at which a gripper grips an individual product, it is possible to calculate in the gripping station a number of grippers that correspond to said multiple and then open a gripper that is located at the laying-off station with the hope of laying-off the individual product that was newly gripped in the gripping station.

This operating method, however, assumes that the gripper conveyor chain has a relatively short length and has a relatively high stability and that the grippers are spaced relatively far apart so as to prevent the "elastic" variation in length of the chain section located between the gripping position and the gripper opening station becoming troublesome. There is a risk of erroneous interpretation when the changes in length of the gripper chain between the stations is able to reach the same order of magnitude as the nominal gripper spacing.

It is possible theoretically to provide each gripper with a code and to read-off the codes at the stations concerned, so that the identity of each gripper can be recognized in each station. This is not possible in practice, however, among other things because of the large number of grippers concerned, all of which must be tracked, and because the gripper flow rate along the conveyor may be as high as twenty grippers per second. The practical difficulties involved in reading the codes correctly in the environments that prevail will be readily understood.

Consequently, the known technique has been directed towards the development of gripping conveyor chains that are as inelastic as possible. However, it is difficult to provide a chain that has a desired low degree of elasticity when the spacing between the grippers becomes shorter and when conveying distances from one gripping station to a laying-off station for instance, are relatively large. This is particularly true when considering all of the relative influences that can occur, such as the phenomenon of thermal expansion, the influence of forces in combination with the modulus of elasticity of the chain materials, the wear on the chain pivots, tolerances in the length of the chain links and the spacing of said links, and so on.

Accordingly, it is an object of the present invention to provide a technique which will enable a given gripper that has gripped a particular product at a first station along the conveyor for instance to be positively and reliably identified with the aid of simple means, so as to enable said product to be actuated or treated at a second station along said conveyor, wherein said actuation or treatment of the product may comprise laying-off the product at a given laying-off station among several mutually separated stations, even though said second station is located far from the first station and even if the gripper spacing is small or the gripper chain has an unfavourable elastic behaviour.

This object is achieved by the inventive method defined in the following independent method Claim. Further developments of the method are set forth in the dependent method Claims.

The object is also achieved with the inventive arrangement defined in the following independent apparatus Claim. Further developments of the arrangement are set forth in the dependent apparatus Claims.

The invention is based on the concept of dividing the chain of the gripping conveyor, which is normally an endless chain, into sections that are so short in relation to their elasticity that variations in the length of each section will be negligible in relation to the-gripper spacing. Further, each section is coded so as to enable the different sections to be identified and to enable the beginning of each section to be determined. A given gripper can now be given an identity address by virtue of its association with the coded section and by, for instance, noting the so-called serial number of the gripper in said section, ie the number of the gripper in the numbered order of said grippers. Precisely this gripper can then be safely found, by first detecting the beginning of the section in which the gripper is located, with the aid of the code, and then counting the number of grippers from the beginning of the section until the gripper concerned is found, wherein said gripper can be positively identified even when the distance between the gripping station and the gripper finding station is so great that the variation in length of the chains along said distance would exceed one gripper spacing.

Normally, the gripping conveyor is based on a chain in which each chain link carries its own gripper/gripper clamp. However, a gripper may belong to a specific number of chain links. The grippers (the clamps) are normally spaced uniformly at a constant distance apart along the conveyor chain. The code for identifying a given chain section, and also a marker for marking the beginning of the code for indicating the first gripper/gripper link of the section are suitably placed at the end of the preceding section. The section code may conveniently be compiled of a series of grippers/gripper links, wherein the first gripper is given a marker which indicates the beginning of a code and thus provides an indication of the position of the first gripper in a new, following section. Each of the subsequent grippers in the series may be provided with a marker holder in which a marker can be placed or not, as desired. The presence or absence of a marker on each gripper/link in the series is detected with the aid of a suitable sensor or detector means, which delivers a corresponding signal, wherewith said gripper series establishes a binary code which is unique to the section concerned. The gripper links defining the section code may be coloured or given some other type of marking which will indicate that said links have a coding function. This enables an operator to be made aware that a shortening or lengthening of the gripping conveyor chain should not occur in the section that defines the code and the beginning of said code. The marker may conveniently be arranged to permit inductive sensing of its presence or its absence, although it will be obvious that other markers/sensor systems may alternatively be used, for instance an optical system.

The arrangement will also suitably include sensor means which sense each passing conveyor gripper and deliver a signal in respect thereof, so as to enable a gripper that has a given so-called serial number to be identified/found after the beginning of the section.

The invention will now be described in more detail with reference to an exemplifying embodiment of a gripping conveyor constructed to grip and lay-off newspapers and with reference to the accompany schematic drawings, in which FIG. 1 illustrates a gripping conveyor schematically;

Figure 1:
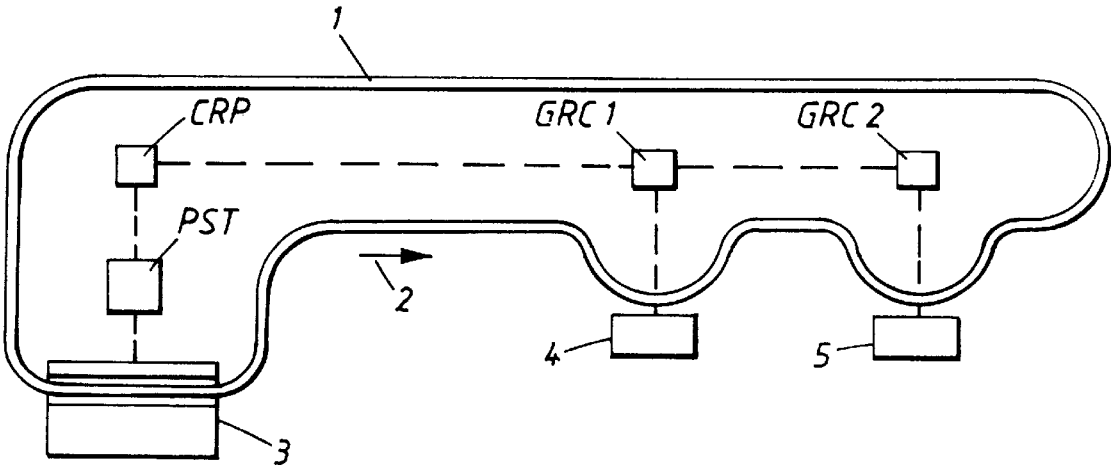

FIG. 1 illustrates an endless gripping conveyor chain 1 which moves in the direction of the arrow 2 through a supplement insertion or interleaving means 3 in which supplements are inserted into newspapers under the control of a supplement insertion computer PST which informs a CRP (central calculating point) which identifies a-gripper that receives a given product in the supplement insertion or interleaving means 3. The product shall now be laid-off at a laying-off station 4, 5 under the control of an associated laying-off control means GRC1 and GRC2 respectively, which in turn communicate with CRP, which is aware of the identity of a gripper whose product is to be laid-off in the selected laying-off station, e.g. station 5.

Figure 2:
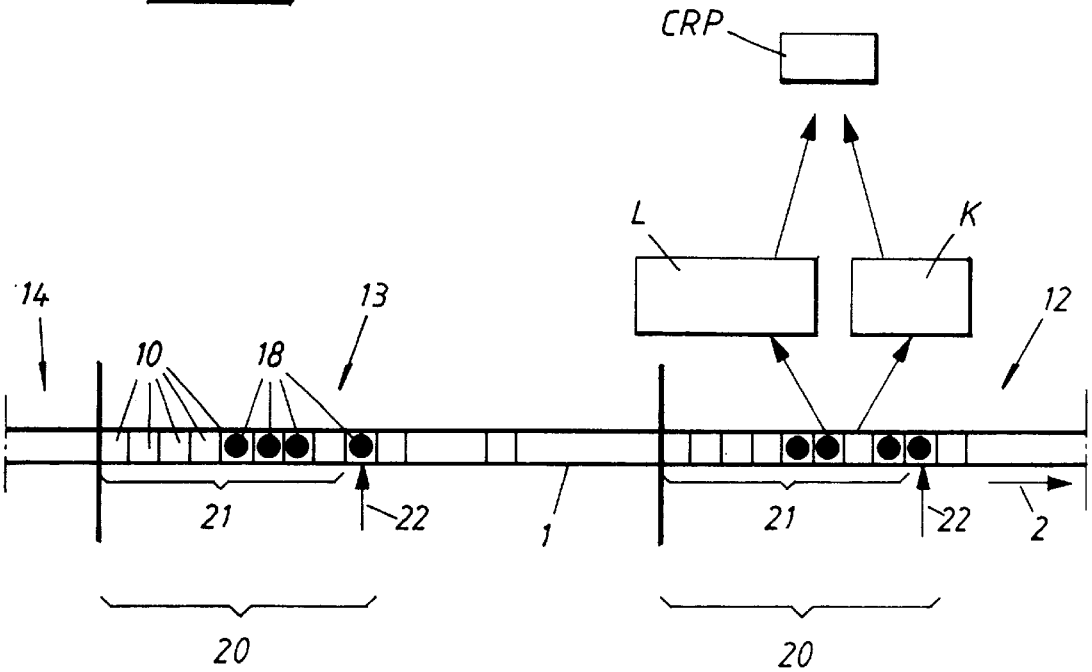
FIG. 2 is a schematic longitudinal section view of the gripping conveyor.

With reference to FIG. 2, which is a schematic longitudinal sectional view of the gripping conveyor chain, it will be seen that the chain is divided into sections wherein the illustrated sectional view includes section number 13 and the sections 14 and 12 adjacent thereto. It can be assumed that the illustrated section includes ninety chain links 10, each carrying a newspaper gripping clamp or clip and each having a length of 10 cm.

The group 20 of the section 12 adjacent the section 13 includes a marker 22 on the foremost link 10 in the direction of chain movement 2. The marker is indicated with a black dot in the schematically illustrated link 10. Some of the links 10 in the following series 21 are provided with a marker, this series comprising eight mutually sequential links in the illustrated case. It will be seen that the absence or the presence of a marker in each of the eight links will define a binary number which with these eight links enables a unique binary code for up to about eight-hundred sections to be established.

The arrangement may now include a sensor K which is activated by the start marker 22 and which senses the following series 21 that defines an identification code for the following section. The arrangement may include a further sensor L which functions to count the links/gripper claws passing along the conveyor. The start marker 22, or the code 21, can be used to identify the first link 10 in each section, so as to enable a gripper claw/link 10 to be identified within the section through its serial number.

Figure 3:
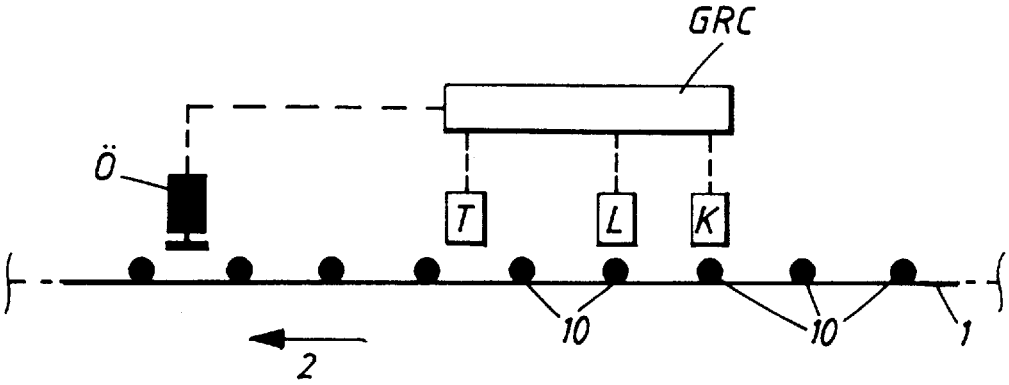
FIG. 3 illustrates schematically the mutual positions of sensors and gripper opening mechanisms along the gripper chain at a laying-off station.

Because the elasticity of the sections will present no disadvantages because of the short lengths of said sections, no problems will arise if a given link/clamp is identified in a section by its serial number from the beginning of the section. As illustrated schematically in FIG. 3, GRC obtains information from the upstream code sensor K and from the position sensor L located downstream of said code sensor, said position sensor L counting the individual links. The arrangement also includes a newspaper sensor 7 which senses the presence or the absence of a newspaper in the gripper (so that it is unnecessary to open an empty gripper). GRC controls the opening mechanism ö for a gripper that is to be opened in the selected laying-off station.

Figure 4:
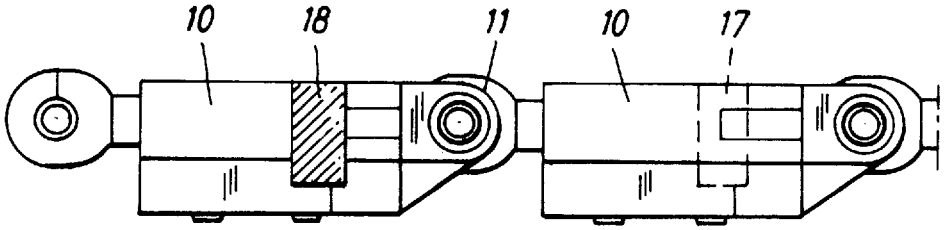
FIG. 4 illustrates schematically coded links in the conveyor chain.

FIG. 4 illustrates two links 10 in the conveyor chain. A gripper clamp can be fastened to respective links in a conventional manner (on the underside of the link shown in FIG. 4). The chain normally runs in a generally C-shaped profile which receives the links 10 and their guide rollers 11, while the link connection with the gripper clamp extends out through the slot of the C-profile. As will be seen from FIG. 4, at least those links 10 that belong to the series 20 include an aperture 17. This aperture 17 may receive a key 18, for instance a ferromagnetic body, which can be readily sensed inductively by the sensor K.

Although the background of the invention and the problems solved thereby have been outlined with reference to gripping and laying-off a product, it will be understood by the person skilled in this art that the inventive concept can be applied to many different specific processes in connection with the handling of newspapers or like products, particularly when the newspapers are made unique in accordance with particular requests and are to be delivered to selected persons or treatment stations, such as laying-off stations.

We claim:

1. A method of identifying and finding a gripper in the transportation of printed products with the aid of a gripping conveyor chain having a plurality of grippers, comprising the steps of:

dividing the gripping conveyor chain into a number of gripping sections, wherein the gripping sections are made sufficiently short that variations in the length of each section will be negligible in relation to the spacing between the grippers;

providing a unique identification code for each section so as to enable each section and the beginning of each section to be identified;

giving each gripper a unique address by virtue of its association with the section in which it is located and by virtue of its sequential position therein; and finding the gripper by sensing the identification code and the address of the gripper within its particular section.

2. A method according to claim 1, characterized by placing the identification code of one section at the end of the preceding section of the chain.

3. A method according to claim 1, characterized by including in a specific gripper series (20) a group (21) of grippers which each have a marking represented by the presence or the absence of a marker element (18) such as to form a binary identification code for the following gripper section.

4. A method according to claim 3, characterized by providing the foremost gripper (22) of said series as seen in the chain conveying direction (2) a marker element which provides code-start and gripper-section start information.

5. A method according to characterized by reading the code by means of a code reader (K) which identifies the following section; and by sensing the passage of each gripper by means of a gripper sensor (L), thereby enabling a gripper within a section to be identified and found with the aid of its so-called serial number in said section.

6. An arrangement for identifying and finding a gripper in a gripping conveyor chain, comprising a gripping conveyor chain which is divided into a number of sections, each of which is sufficiently short that variations in the length of each section will be negligible in relation to the spacing between the grippers; the conveyor chain carrying unique identification codes which identify each section and its beginning; the arrangement including a code reader which functions to read said identification codes, and a sensor which functions to sense the grippers in their particular section, thereby enabling a given gripper to be found by reading the identification code of the particular section and sensing the position of the gripper within the particular section.

7. An arrangement according to claim 6, characterized in that the section code is carried by grippers in the preceding section.

8. An arrangement according to claim 7, characterized in that the code is compiled of a series (20) of grippers including a group (21) of grippers which either carry or do not carry a marker (18), so as to form a code which identifies the following gripper section.

9. An arrangement according to claim 8, characterized in that the series includes a gripper which lies foremost in the direction of chain movement (2) and which includes a marker that indicates the start of the code and the start of the following section.

10. An arrangement according to claim 6, characterized by a sensor (K) which senses the section code and the beginning of the following section, a sensor (L) which senses passing grippers to enable a gripper within the identified section to be identified and found with the aid of the serial number of said gripper from the beginning of said section.

* * * * *